US007997959B2

(12) United States Patent
Hutchins et al.

(10) Patent No.: US 7,997,959 B2
(45) Date of Patent: Aug. 16, 2011

(54) PNEUMATIC TOOL HAVING A ROTOR WITH A WEAR-RESISTANT VANE SLOT

(75) Inventors: Donald H. Hutchins, Sierra Madre, CA (US); Jenni D. Hutchins, Pasadena, CA (US)

(73) Assignee: Hutchins Manufacturing Company, Pasadena, CA (US)

( * ) Notice: Subject to any disclaimer, the term of this patent is extended or adjusted under 35 U.S.C. 154(b) by 317 days.

(21) Appl. No.: 12/372,679

(22) Filed: Feb. 17, 2009

(65) Prior Publication Data

US 2009/0209179 A1 Aug. 20, 2009

Related U.S. Application Data

(60) Provisional application No. 61/029,339, filed on Feb. 16, 2008.

(51) Int. Cl.
*B24B 23/00* (2006.01)

(52) U.S. Cl. ..... 451/294; 451/357

(58) Field of Classification Search ..... 451/294, 451/357, 359

See application file for complete search history.

(56) References Cited

U.S. PATENT DOCUMENTS

| | | | | |
|---|---|---|---|---|
| 1,143,725 | A | 6/1915 | Reed | |
| 2,077,693 | A * | 4/1937 | Herrero | 451/358 |
| 2,326,396 | A * | 8/1943 | Schaedler | 418/43 |
| 3,283,352 | A | 11/1966 | Hu | |
| 3,890,069 | A | 6/1975 | Telang et al. | |
| 4,058,936 | A | 11/1977 | Marton | |
| 4,177,024 | A * | 12/1979 | Lohn | 418/16 |
| 4,434,587 | A | 3/1984 | McDougall | |
| 4,592,170 | A | 6/1986 | Hutchins et al. | |
| 4,660,329 | A | 4/1987 | Hutchins | |
| 4,671,019 | A | 6/1987 | Hutchins | |
| 4,839,995 | A | 6/1989 | Hutchins | |
| 4,854,085 | A | 8/1989 | Huber | |
| 4,924,633 | A | 5/1990 | Hock et al. | |
| 4,924,636 | A | 5/1990 | Hoffman | |
| 4,986,036 | A | 1/1991 | Hutchins | |
| 5,007,778 | A | 4/1991 | Hillestad et al. | |
| 5,165,881 | A | 11/1992 | Wicen | |
| 5,245,243 | A | 9/1993 | Ohnishi et al. | |
| 5,253,990 | A | 10/1993 | Hutchins | |
| 5,319,888 | A * | 6/1994 | Huber et al. | 451/357 |

(Continued)

*Primary Examiner* — Robert Rose

(74) *Attorney, Agent, or Firm* — Christie, Parker & Hale, LLP

(57) ABSTRACT

This invention relates generally to an improved rotor for a pneumatic abrading or polishing tool, such as an orbital abrading or polishing tool, and more particularly to such a rotor having a wear-resistant vane slot. A power abrading or polishing tool, such as a pneumatic orbital abrading or polishing tool, includes a motor having a rotor that transmits a rotational force to a carrier part having an abrading or polishing head attached thereto. The rotor is contained in a motor housing which includes an inlet passage and one or more exhaust passages. Compressed air or other suitable gas enters the motor housing through the inlet passage and causes the rotor to rotate within the motor housing. As the rotor rotates, vanes slide in and out of slots in the rotor, creating sealed chambers or compartments between adjacent vanes. As the compressed gas expands within these compartments, it pushes on the vanes, causing the rotor to rotate and the vanes to slide in and out of their vane slots. The rotor includes a metal clip lining the inside surface of the vane slots to prevent wear on the slots due to the repeated movement of the vanes in and out of the slots.

20 Claims, 6 Drawing Sheets

U.S. PATENT DOCUMENTS 5,347,673 A 9/1994 Nickels, Jr.
5,392,568 A 2/1995 Howard, Jr. et al.
5,411,386 A 5/1995 Huber et al.
5,445,558 A 8/1995 Hutchins
5,464,366 A 11/1995 Hutchins
5,518,441 A 5/1996 Valentini
5,580,302 A 12/1996 Howard, Jr. et al.
5,582,541 A 12/1996 Hutchins
5,595,530 A 1/1997 Heidelberger
5,597,348 A 1/1997 Hutchins
5,823,862 A 10/1998 Heidelberger
5,879,228 A 3/1999 Sun
6,007,412 A * 12/1999 Hutchins ..... 451/295
6,190,245 B1 2/2001 Heidelberger et al.
6,257,970 B1 7/2001 Huber
6,390,477 B1 5/2002 Drago et al.
6,485,360 B1 11/2002 Hutchins
6,752,705 B1 * 6/2004 Lin ..... 451/295
7,008,187 B2 3/2006 Cazzaniga
7,220,098 B2 5/2007 Bruce et al.
7,662,027 B2 * 2/2010 Hutchins ..... 451/344
2006/0073032 A1 4/2006 Parrett
2006/0110246 A1 5/2006 Bruce
2008/0076337 A1 * 3/2008 Hutchins ..... 451/357
2008/0160887 A1 7/2008 Hutchins
2008/0160888 A1 * 7/2008 Hutchins ..... 451/359
2008/0219877 A1 9/2008 Kjeldsen et al.

* cited by examiner

FIG. 1
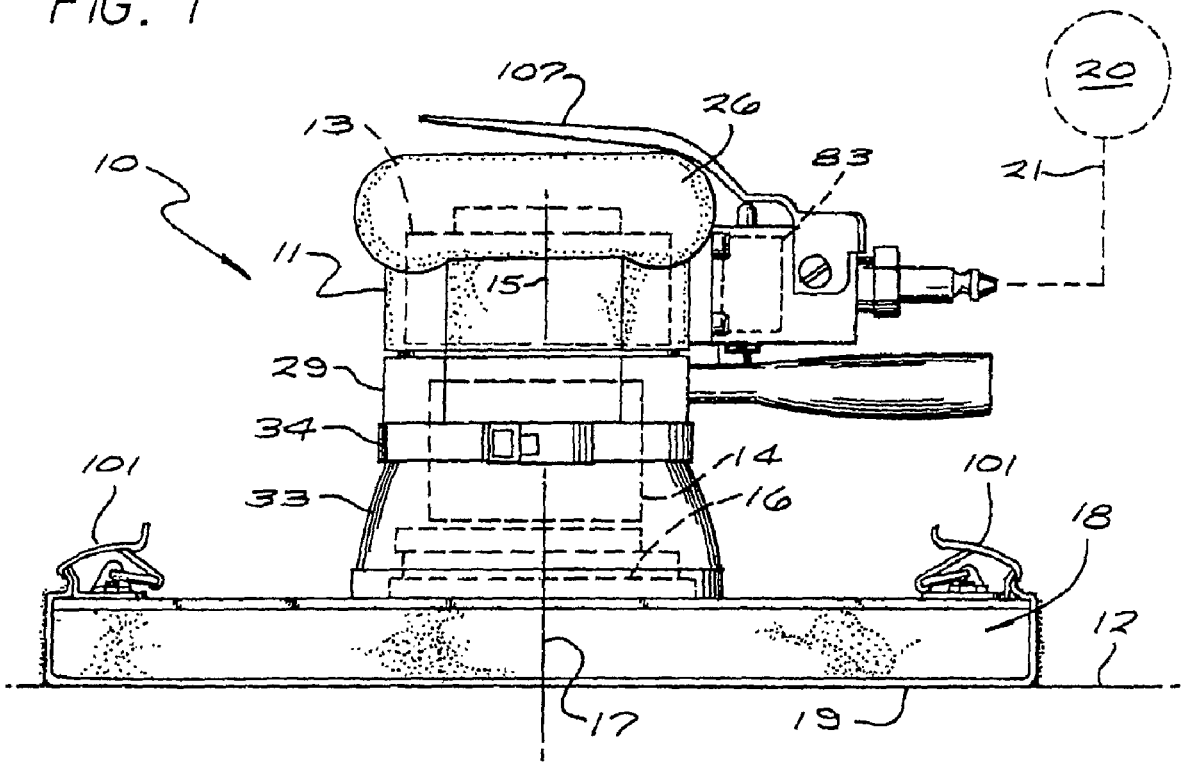
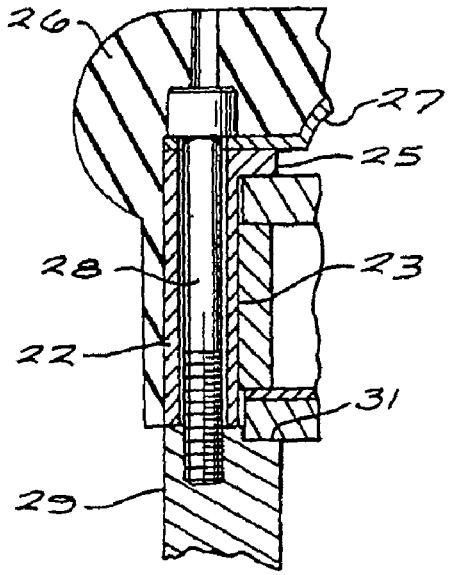
FIG. 4

PNEUMATIC TOOL HAVING A ROTOR WITH A WEAR-RESISTANT VANE SLOT

CROSS-REFERENCE TO RELATED APPLICATION(S)

This application claims the benefit of U.S. Provisional Patent Application No. 61/029,339, filed Feb. 16, 2008, the disclosure of which is hereby incorporated by reference herein.

FIELD OF THE INVENTION

This invention relates generally to an improved rotor for a pneumatic abrading or polishing tool, such as an orbital abrading or polishing tool, and more particularly to such a rotor having a wear-resistant vane slot.

BACKGROUND

A known orbital abrading or polishing tool includes a motor having a rotor which rotates inside a motor housing. The rotor transmits a rotational force to a carrier part having an abrading or polishing head attached thereto. A key typically extends from the carrier part and engages a keyway in the rotor, such that rotation of the rotor causes a corresponding rotation of the carrier part and the abrading or polishing head. Compressed air enters the motor housing through the inlet passage and causes the rotor to rotate within the motor housing. As the rotor rotates, vanes slide in and out of slots in the rotor, creating sealed chambers or compartments between adjacent vanes. As the compressed gas expands within these compartments, it pushes on the vanes, causing the rotor to rotate and the vanes to slide in and out of their vane slots. The expanded air is then exhausted through one or more exhaust passages in the motor housing, and the process is repeated.

Each vane slides partially out of and then back into its rotor slot every time the rotor makes one complete rotation. When the rotor spins at very high speeds, the vanes slide in and out very quickly. As a result, the vanes can wear down the surface of the vane slots formed inside the plastic rotor. The wearing of the vane slots produces debris in the rotor housing which can further abrade the vane slots and the vanes themselves. After a certain amount of time, the vane slots are abraded to such an extent that they cannot contain the vanes as they slide rapidly in and out of the slots, and the plastic rotor fails and has to be replaced.

Accordingly, there is a need for an improved rotor with a wear-resistant vane slot.

SUMMARY OF THE INVENTION

In accordance with the present invention, an abrasive finishing tool having a rotary pneumatic motor is provided. The motor includes a rotor that rotates inside a motor housing. Compressed air enters the motor housing through an inlet and causes the rotor to rotate. As the rotor rotates, vanes slide in and out of slots in the rotor. The vane slots are reinforced with a metal clip that is received within a recess in the surface of the vane slots, so that the clip protects the vane slot from the repeated sliding motion of the vanes. The metal clip reduces wear of the rotor in the region of the vane slots, extending the useful life of the rotor and vanes.

BRIEF DESCRIPTION OF THE DRAWINGS

FIG. 1 is a side elevational view of an abrasive finishing tool according to an exemplary embodiment of the invention;

FIG. 4 is a fragmentary vertical cross-sectional view taken on the line 4-4 of FIG. 3;

DETAILED DESCRIPTION

Figure 2:
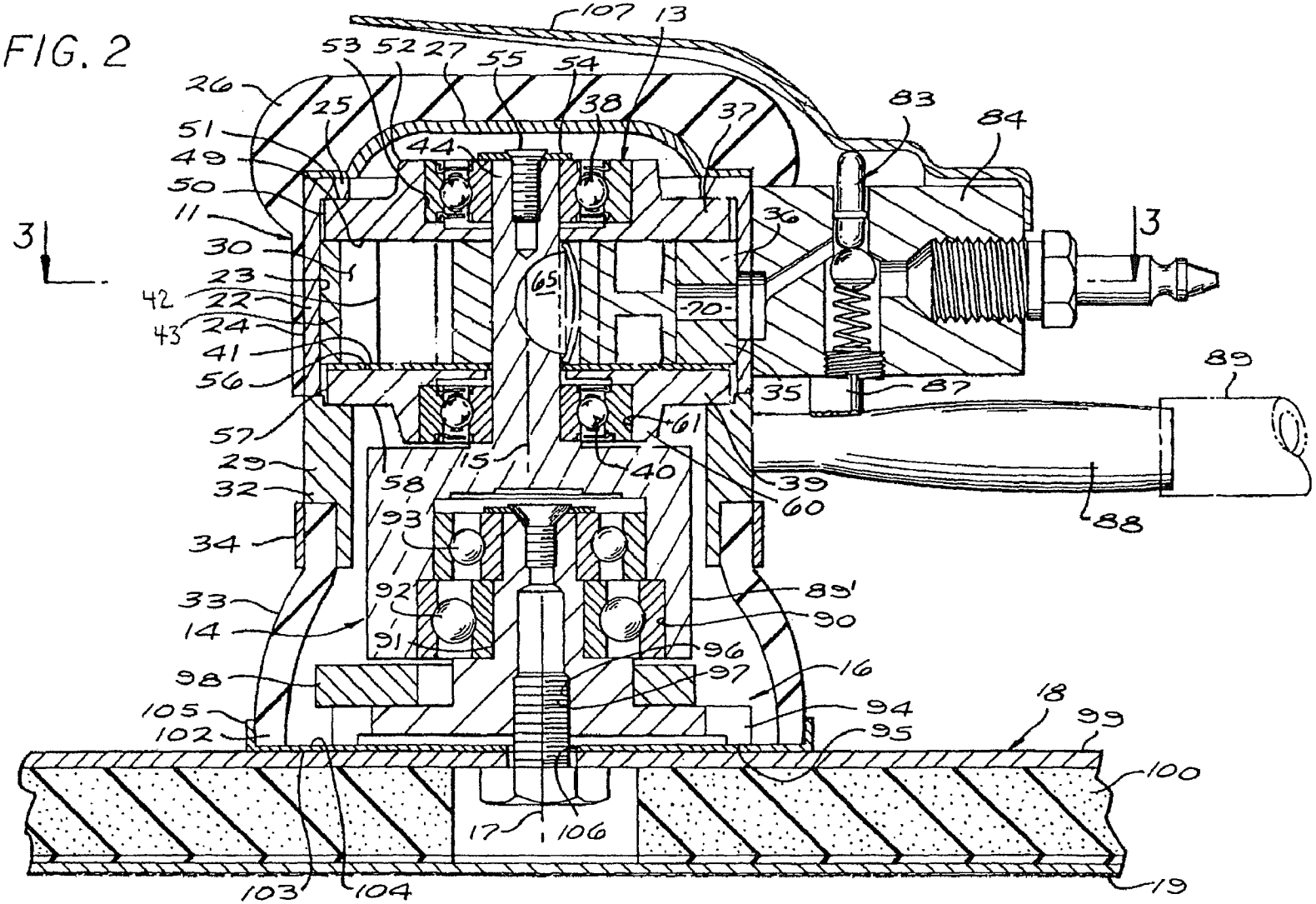
FIG. 2 is an enlarged central vertical cross-sectional view of the abrasive finishing tool of FIG. 1.

As shown in FIGS. 1-8, embodiments of the present invention are directed to a power abrading or polishing tool, such as a pneumatic orbital abrading or polishing tool, which includes a motor having a rotor that transmits a rotational force to a carrier part having an abrading or polishing head attached thereto. The rotor is contained in a motor housing which includes an inlet passage and one or more exhaust passages. Compressed air or other suitable gas enters the motor housing through the inlet passage and causes the rotor to rotate within the motor housing. As the rotor rotates, vanes slide in and out relative to slots in the rotor, creating sealed chambers or compartments between adjacent vanes. As the compressed gas expands within these compartments, it pushes on the vanes, causing the rotor to rotate and the vanes to slide in and out. In exemplary embodiments of the invention, the rotor includes a clip of a material harder than the rotor that lines the inside surface of the vane slots to prevent wear from repeated movement of the vanes in and out of the slots.

As shown in FIG. 1, an orbital tool 10 has a body structure 11 shaped externally as a handle to be grasped by a user for holding the tool and moving it along a typically horizontal work surface 12 to sand or polish that surface. In operating the tool, a user holds the tool by grasping the upper handle portion 26 and then pressing downwardly on a lever 107 to open a valve 83 and thereby admit compressed air or other suitable gas to the motor 13. Thus, air may be supplied to the motor cavity from a source 20 (shown schematically) of compressed air through a line 21 connecting into the rear of body structure 11.

Figure 3:
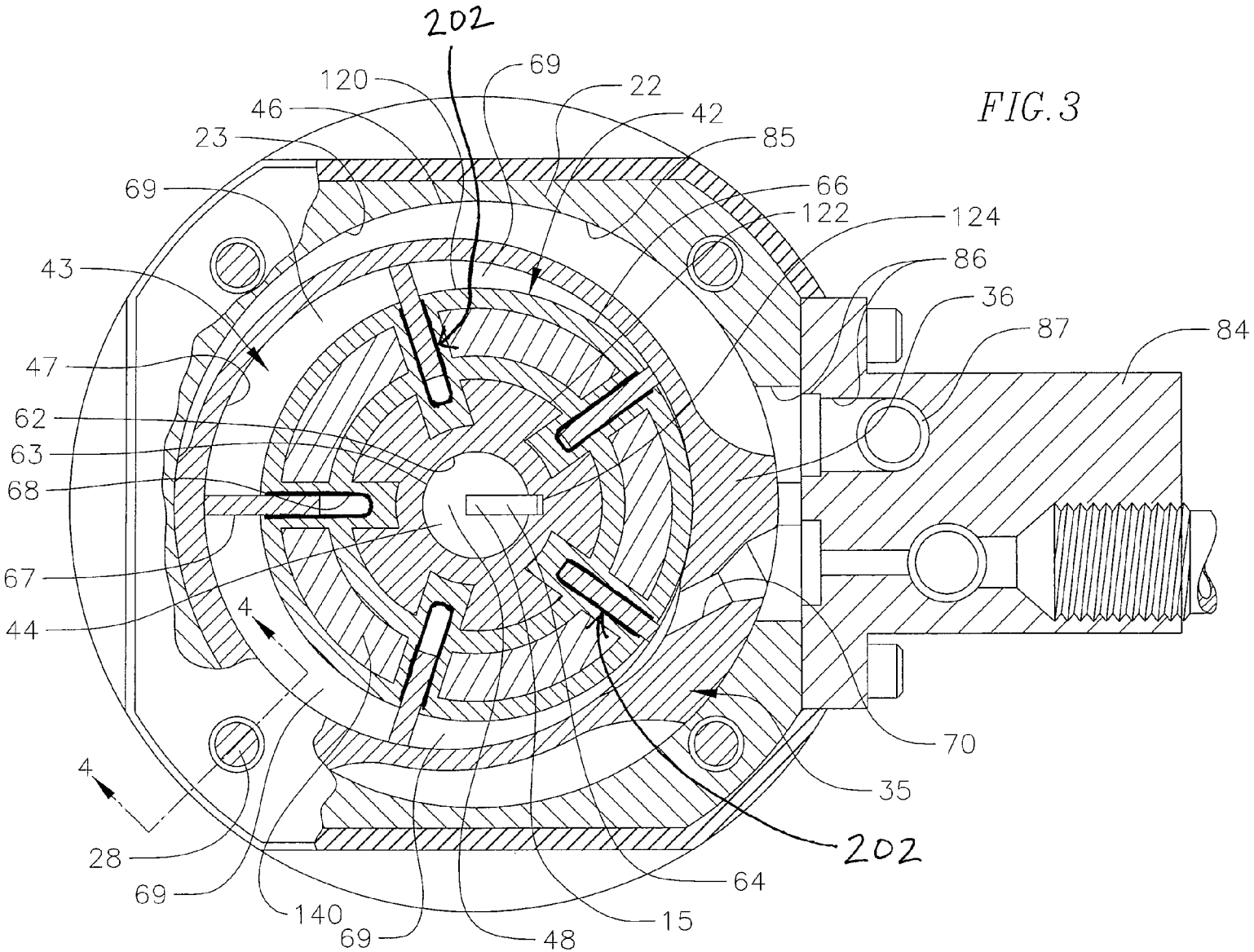
FIG. 3 is a horizontal cross-sectional view taken primarily on the line 3-3 of FIG. 2.

As shown in FIG. 3, the motor housing 35 includes an inlet passage 70 through which compressed air flows into the motor cavity 43, and exhaust passages through which air flows out of the cavity. Compressed air is delivered to the inlet passage 70 from the inlet line 21 through the manually actuable valve 83. The valve 83 is contained within a block 84 attached to the tool's rigid main body part 22.

When compressed air enters the motor cavity 43, it causes the rotor 42 of the motor 13 to rotate. The air driven motor 13 drives a carrier part 14 rotatively about a primary vertical axis 15 (see FIG. 2). An orbitally driven part 16 is connected to the carrier part 14 for free rotation about a secondary vertical axis 17 displaced horizontally from the primary vertical axis 15. The part 16 carries an abrading or polishing head or shoe 18 and an abrasive or polishing sheet 19 as the part 16 moves orbitally about the axis 15 to sand or polish the surface 12. Thus, when the user grasps the tool 10 and presses down on the lever 107, the compressed air enters the motor cavity 43 and causes the rotor 42 to rotate, causing orbital motion of the abrading head 18.

The rotor 42 spins inside a stator or housing 35 of the motor 13. The housing 35 has a vertical inside wall 47 which may be cylindrical but eccentric with respect to the primary axis 15. Externally, the rotor 42 has a vertical cylindrical surface 66 centered about the axis 15 and therefore eccentric with respect to the inside wall 47 of the motor housing 35 as seen in FIG. 3. The rotor 42 has a plurality of vanes 67 which are free to slide radially within slots 68 to contact the inside wall 47 of the housing 35 and to divide the space between the rotor 42 and the housing 35 into a plurality of chambers 69. The chambers 69 vary progressively in size as the rotor turns so that the introduction of air into these chambers through an inlet passage 70 in the side wall 36 of the motor housing 35 causes rotation of the rotor in a clockwise direction as viewed in FIG. 3, and hence a corresponding rotation of the carrier part 14 and the head 18. As the rotor 42 spins, the vanes 67 slide in and out of their individual slots 68 and their corresponding clips 202 lining them to remain in contact with the inside wall 47 and to thereby substantially seal the individual chambers 69 from each other.

Compressed air enters an individual chamber 69 through the inlet passage 70 and begins to expand inside that chamber 69. This expanding air causes the rotor 42 to rotate against the inside wall 47 of the housing 35. As the rotor rotates, the individual chamber 69 increases in size and the adjacent vanes 67 slide out of their slots 68 to maintain contact with the inside wall 47. The air expands and the rotor rotates until the chamber 69 overlaps the exhaust passages 302 and 304. The expanded air is then free to exit through these exhaust passages 302 and 304 and flow through outlet passages 86 in the body 22 and block 84. The outlet passages 86 lead to a vertical tube 87 in the block 84, and this tube 87 delivers the exhaust downwardly into an exhaust tube 88 leading to a discharge hose 89.

Figure 6:
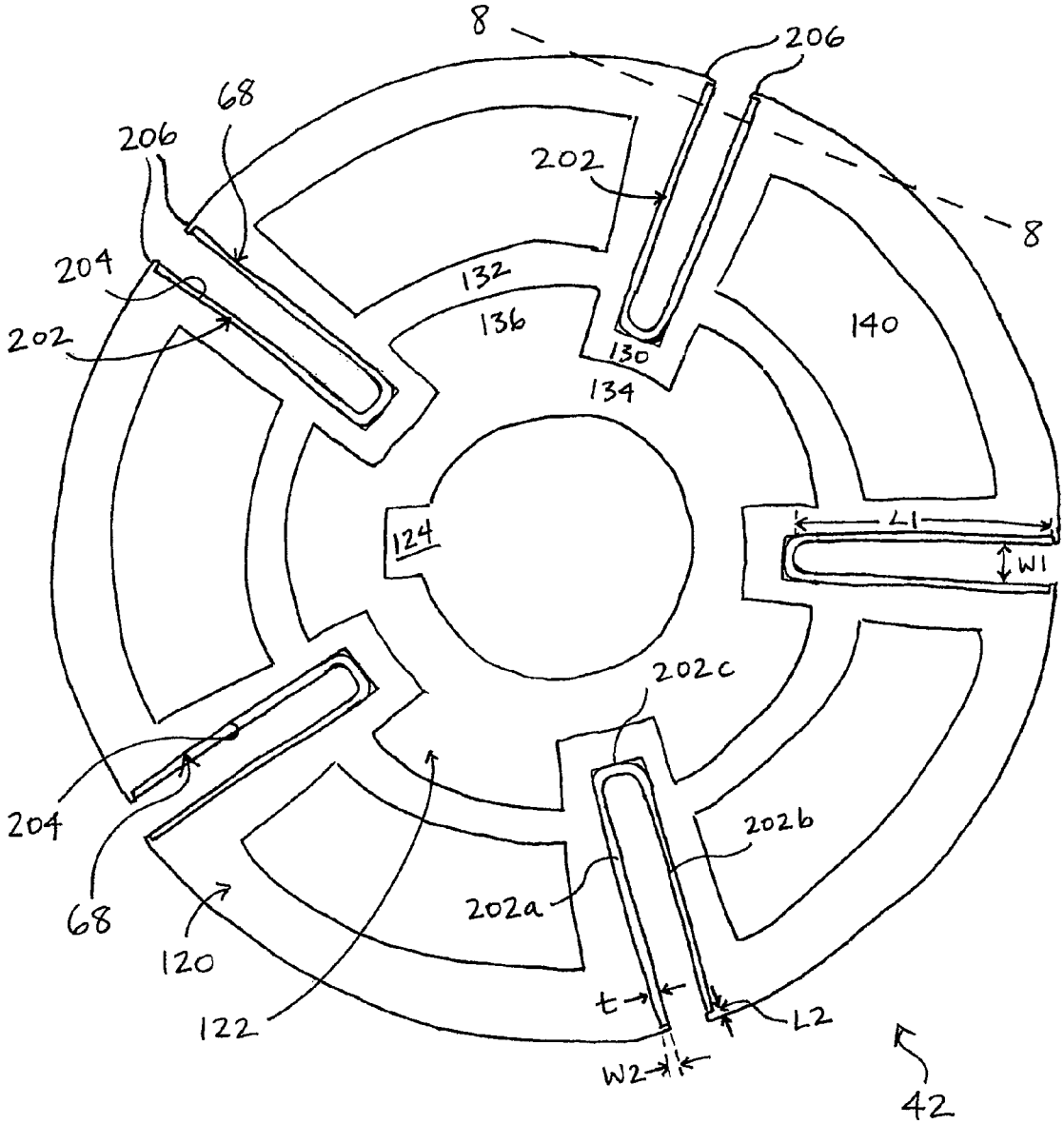
FIG. 6 is an enlarged top plan view of a rotor according to an exemplary embodiment of the invention.
Figure 7:
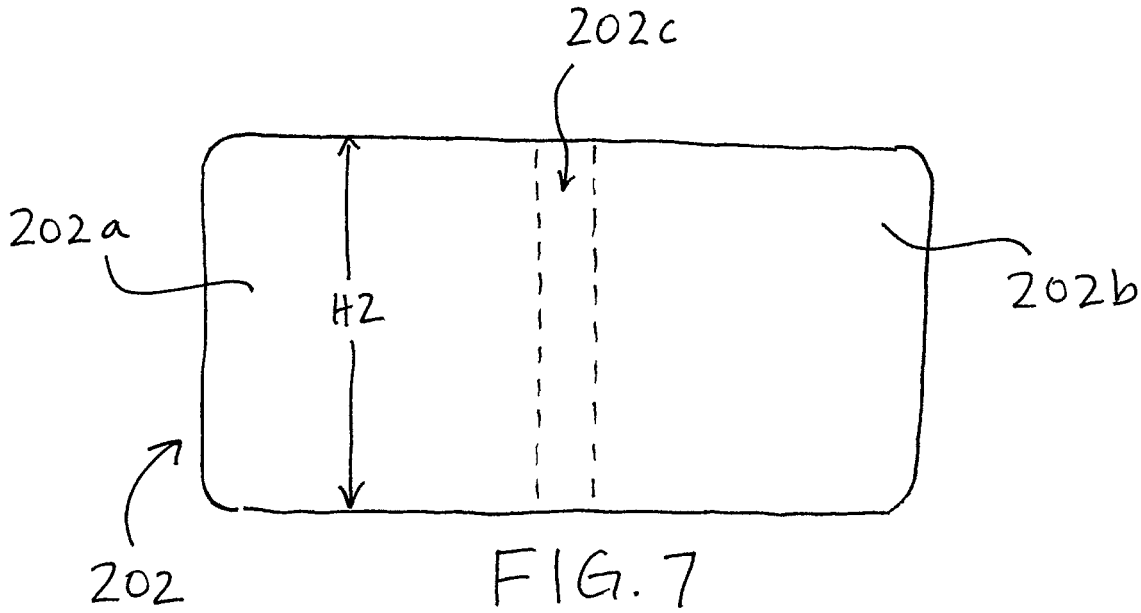
FIG. 7 is a front elevational view of a clip for a vane slot according to an exemplary embodiment of the invention, with the clip shown in its unbent condition.
Figure 8:
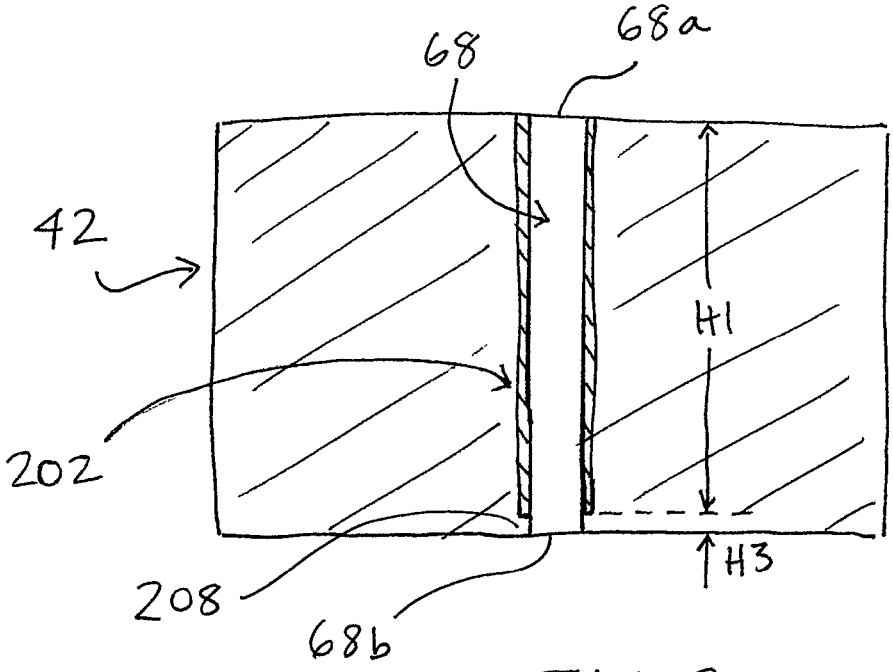
FIG. 8 is a vertical cross-sectional view of the rotor of FIG. 6 taken along the line 8-8 of FIG. 6.

In the embodiment shown in FIGS. 6-8, the rotor 42 includes clips or liners 202 positioned inside of the vane slots 68. The clips 202 are inserted into the vane slots 68 to protect the inside surfaces 204 of the slots from wear due to the movement of the vanes 67 in and out of the slots 68. With the clips 202 in place in each vane slot 68, the vanes 67 slide against the clips 202 rather than the inside surface 204 of the vane slot. The lightweight material of the rotor forming the vane slots 68 is thereby protected from wear. The clips themselves are made of a material substantially harder than the rotor that can withstand the repeated movement of the vanes 67 without undue wear.

A pair of lips 206 extends along the front edges of each slot 68 to retain the clip 202 inside the slot. Each lip 206 may extend from the top of the rotor to the bottom, or it may be formed only at certain points along the rotor rather than being continuous from top to bottom. As the rotor 42 spins inside the housing, the lips 206 retain the clips 202 inside the slots, preventing them from sliding out along with the vanes.

FIG. 7 shows a clip 202 before it is bent and inserted into one of the slots 68. The clip 202 is bent along the dotted lines to form a U-shape in order to fit the clip into the slot 68. When installed into the slot 68, the two side portions 202*a* and 202*b* of the clip 202 abut the sides of the slot 68, with the narrow middle portion 202*c* of the clip against the back end of the slot 68, as shown in FIG. 6. The clip 202 has rounded corners to facilitate insertion into the slot 68, preventing the clip 202 from scratching the inside of the slot as it is inserted.

FIG. 8 shows a cross-sectional view of the rotor taken along the line 8-8 in FIG. 6. The clip is folded into its U shape and inserted into the slot 68 from the top opening 68*a* of the slot, on the top side of the rotor. The clip is slid down into the slot toward the bottom 68*b* of the slot, until the clip hits a shelf 208 formed near the bottom 68*b* of the slot. The shelf 208 seats the clip in place in the slot and prevents the clip from sliding out the bottom of the slot.

The dimensions of the slot 68, the clip 202, the lip 206, and the shelf 208 can vary according to the particular air motor. In one embodiment, the clip is 0.010 inches in thickness t, and the middle portion 202*c* has a width W1 of 0.075 inches measured across the inside after it has been folded, as shown in FIG. 6. Each side portion 202*a*, 202*b* may then have a length L1 of 0.350 inches, measured from the tip of the clip near the lips 206 to the inside of the middle portion 202*c*, as shown in FIG. 6. The lips 206 formed at the front of each slot 68 may extend into the slot a distance L2 of 0.050 inches and across the slot a distance W2 of 0.010 inches, the same as the thickness t of the clip. The height H1 of the slot 68 from the top 68*a* of the slot to the top of the shelf 208 is 0.760 inches. The clip itself has a height H2 of about 0.700 inches. The height H3 of the shelf is about 0.040 inches. Dimensions in the figures are exaggerated for clarity, and are not necessarily to scale. Furthermore, the dimensions can vary, and the dimensions given above are only approximate measurements of the dimensions in one exemplary embodiment.

The clip 202 protects the inside surface 204 of the slot 68 from wear of the vane repeatedly sliding in and out of the slot. In oil-free motors, this wear-reducing clip can be particularly useful, as the oil-free motors do not use any oil as a lubricant for the motor. The motor is run dry, using only compressed air to turn the rotor. As a dry vane moves in and out of one of the slots, it wears down the vane slot 68 and creates debris that builds up inside the motor housing 35. This debris can abrade the outer edges of the vanes themselves, creating even more debris that further wears on the vanes and slots. As a result, the vane may fail to achieve a tight seal against the inside wall 47 of the motor housing 35, and/or the rotor may fail to contain the vanes as they slide in and out of the deteriorating slots. With the protective clip 202 in place, the deterioration of the vane slot is reduced, and the rotor can be used in oil-free, dry motors. The clip 202 reduces friction between the vane 67 and the vane slot 68, thereby preventing wear on the slot.

The clip 202 can be made of any hard material that can withstand repeated sliding contact with the vanes 67. In one embodiment, the clip 202 is a mild cold rolled steel that is annealed to give it a sufficient hardness, such as 1075 steel, cold rolled and annealed to give it a hardness of 45-50 on the Rockwell C scale. In another embodiment, the clip 202 is made of 5052 Aluminum, hard anodized to 70 on the Rockwell C scale. Many other options are available for materials for the clip 202.

The vanes 67 can be made of any suitable strong, lightweight material, such as bronze, polymer, silicon, Teflon, or carbon fiber. In one embodiment, the vanes are made of Spauldite Grade ARK-2, an aramid fiber in a phenolic resin, available from Spaulding Composites, Inc. in Rochester, N.H.

Figure 5:
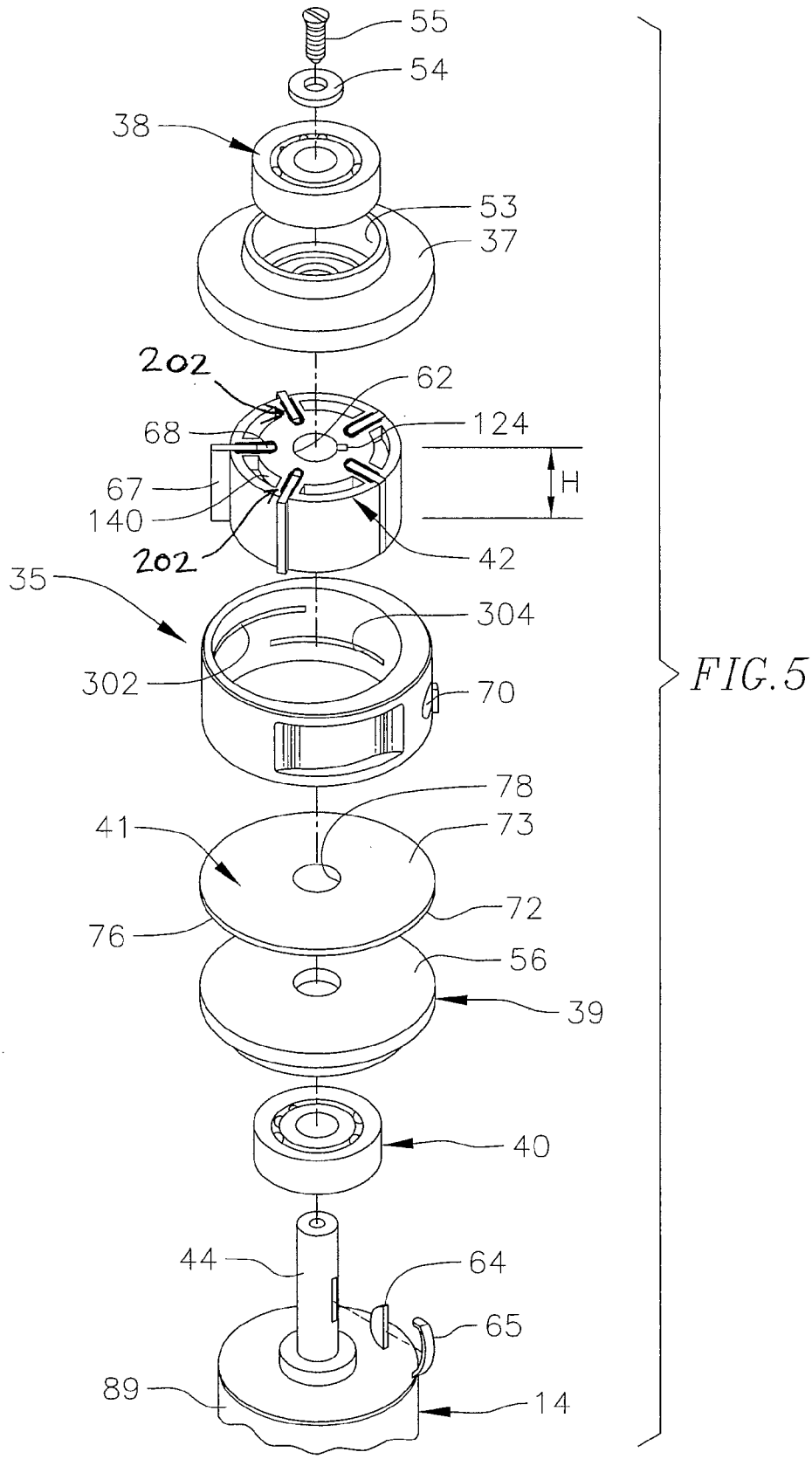
FIG. 5 is an exploded perspective view of various components of an air motor of the abrasive finishing tool of FIG. 1.

As shown in FIGS. 5 and 6, the rotor 42 includes a generally cylindrically-shaped outer body 120 that surrounds a central core 122. The outer body 120 is composed of a first material and the core 122 is composed of a second material having a greater resistance to wear than the first material. In one embodiment, the core 122 may be made of or comprise a suitable metallic material, such as steel or a composite containing metallic powder, and has a high resistance to wear.

The outer body 120 may be made of or comprise aluminum or other light metallic alloys or compositions, or any suitable polymeric material having sufficient strength and durability to withstand the rotational forces to which the rotor 42 is subjected. The outer body 120 may also be moldable to form an integral body with the core 122. Materials for the outer body 120 include a variety of olefins, phenolics, acetals, polyamides (including 612 nylon or carbon fiber filled 46 nylon), or other suitable resinous materials. In a particular embodiment, a synthetic material used for the outer body 120 may be reinforced by any fibrous material suitable for use in a bearing structure, such as glass fiber, carbon fiber, or synthetic fibers such as aramid. In one embodiment, the outer body 120 is formed of polyphenylene sulfide reinforced with glass fiber or carbon fiber, available from Caltron. In another embodiment, the rotor is formed of nylon reinforced with approximately 30% glass fiber. Rotors made of steel have been tried in the past, but they are very heavy, and they tend to generate excessive heat when they spin at high speeds in the motor housing.

As shown in FIGS. 5 and 6, the radial slots 68, which receive the vanes 67 (described above), are disposed in the outer body 120 of the rotor 42, and the inner cylindrical passage 62 forms a through passage in the core 122. The inner cylindrical passage 62 includes a keyway 124 that receives the key 64 of the shaft 44 of the carrier part 14. Preferably, the core 122 of the rotor 42 is non-rotatably coupled to the outer body 120 of the rotor 42, such that when compressed air flows against the vanes 67 causing a rotation of the outer body 120 of the rotor 42 (described below), the core 122 correspondingly rotates, which in turn causes a rotation of the carrier part 14 via the interaction of the keyway 124 of the core 122 and the key 64 of the shaft 44 of the carrier part 14.

In one embodiment, as shown in FIG. 6, in order to prevent a relative rotation between the outer body 120 and the core 122, an inner surface of the outer body 120 includes an alternating series of protrusions 130 and recesses 132, and the outer surface of the core 122 includes a corresponding alternating series of protrusions 136 and recesses 134. Each protrusion 130 on the inner surface of the outer body 120 mates with a corresponding one of the recesses 134 in the outer surface of the core 122, and each protrusion 136 on the outer surface of the core 122 mates with a corresponding one of the recesses 132 in the inner surface of the outer body 120. This causes the core 122 and the outer body 120 to interlock securely with one another to prevent rotation between them. In one embodiment, the rotor 42 is formed by molding, casting or otherwise forming the outer body 120 onto the core 122. One such process is the injection molding of the outer body 120 onto the core 122. In such processes, the core 122 becomes integrally attached to the outer body 120.

In one embodiment, as shown in FIG. 6, each radial slot 68 is aligned with and extends into a corresponding one of the protrusions 130 on the inner surface of the outer body 120. This maximizes the depth to which each radial slot 68 may extend. In addition, in this embodiment, each protrusion 136 on the outer surface of the core 122 extends between adjacent ones of the radial slots 68. This arrangement reduces the likelihood of the rotor 42 fracturing in use at one of the radial slots 68. Because the known non-metallic rotor (described above) does not include the described reinforcing metal core 122 of greater wear resistance, the radial slots in the known rotor cannot be made to the same depth as those of the present rotor 42 without risk of fracture. This is significant because the stability of a vane is directly related to the proportion of the vane contained within the slot.

In one embodiment, the outside diameter (OD) of the rotor 42 is approximately 1.35 inches, the depth (D) of each radial slot 68 is approximately 0.415 inches, and the width (W) of each radial slot 68 is approximately 0.070 inches. As such, each radial slot 68 is formed to a depth that is approximately 30% of the outer diameter (OD) of the rotor 42.

As is also shown in FIG. 6, a cavity 140 may be disposed between each radial slot 68 and adjacent to each protrusion 136 on the outer surface of the core 122. These cavities 140 extend into the rotor 42 from both its upper surface and its lower surface (see FIG. 2), terminating in a central web adjacent the core 122. As such, the cavities 140 reduce the overall mass of the rotor 42 without adversely affecting its torsional stability. Because the rotor 42 has the core 122 with protrusions 136, the rotor 42 is light but extremely durable. The use of a metallic core avoids wear at the keyway 124, and the protrusions 136 permanently lock the polymeric outer body 120 of the rotor 42 to the core 122 of the rotor 42. The disclosed rotor 42 is therefore able to operate in its intended manner indefinitely.

As shown in FIGS. 2 and 5, the housing 35 includes a vertically extending side wall 36, a top wall portion 37 carrying a bearing 38, and a bottom wall 39 carrying a second bearing 40. A horizontal circular plate 41 is located above the bottom wall 39. The rotor 42 of the motor is contained and driven rotatively within the motor cavity 43 formed by the housing parts. The housing 35 may be made of any durable material, such as steel or other ferrous material. The housing 35 also includes a key 312 (shown in FIG. 7) which engages the rigid body 22 to prevent relative rotation or movement between the housing 35 and the body 22.

As shown in FIG. 3, the side wall 36 of the motor housing has an external cylindrical surface 46 which fits closely within and engages the internal cylindrical surface 23 of the rigid main body part 22. Internally, the side wall 36 has a vertical surface 47 which may be cylindrical but eccentric with respect to axis 15, and more particularly may be centered about a vertical axis 48 which is parallel to but offset from the axis 15 to give the desired eccentricity to the surface 47.

As shown in FIGS. 2 and 5, the top wall portion 37 has a planar horizontal undersurface 49 forming the top of cavity 43 within which the rotor 42 is received. The top wall portion 37 has an outer edge surface 50 which is received closely adjacent the internal surface 23 of the part 22. At its upper side, the top wall portion 37 has an annular surface 51 which is engaged by the annular flange 25 of the body part 22 to clamp the top wall portion 37 downwardly against the side wall 36 of the motor housing 35. Radially inwardly of the surface 51, the top wall portion 37 has an annular portion 52 defining a cylindrical recess 53 within which the outer race of the ball bearing 38 is received and located. The externally cylindrical vertical shaft portion 44 of the carrier 14 is a close fit within the inner race of the bearing 38, and is retained against downward withdrawal from the bearing 38 by a washer 54 secured to the shaft 44 by a screw 55 connected into the upper end of the shaft. The washer projects radially outwardly far enough to engage the upper surface of the inner race of the bearing 38 to maintain the parts in assembled condition.

The bottom wall 39 of the motor housing or stator is similar to the top wall portion 37, but inverted with respect to the top wall. More particularly, the bottom wall 39 has an upper planar horizontal surface 56, a cylindrical outer edge surface 57 which fits fairly closely within the cylindrical surface 23 of the body part 22, and a horizontal annular undersurface 58 which is engaged annularly by the shoulder surface 31 of the retainer 29 to clamp the bottom wall 39 upwardly against the side wall 36 of the motor housing 35. Radially inwardly of the surface 58, the bottom wall 39 has a downwardly projecting annular portion 60 defining an essentially cylindrical recess 61 within which the bottom ball bearing assembly 40 is received and located. The inner race of the bearing 40 is a close fit about the externally cylindrical shaft portion 44 of the carrier 14, to contact with the upper bearing 38 in the mounting part 14 for its desired rotation about the axis 15.

The top wall portion 37, bottom wall 39, and motor housing 35 form the motor cavity 43 within which the rotor 42 spins. As shown in FIG. 5, the rotor 42 is connected to an upper shaft portion 44 of the carrier 14, to drive that carrier rotatively about axis 15. The rotor 42 has an inner cylindrical passage 62 that fits closely about the external cylindrical surface 63 of the shaft portion 44 of the carrier part 14. A key 64 received within opposed axially extending grooves in parts 44 and 42 transmits rotary motion from the rotor 42 to the shaft 44. A leaf spring 65 interposed radially between the rotor and key may exert radial force in opposite directions against these parts to take up any slight looseness which may occur.

As described above, a key 64 extends from the carrier part 14 and engages the keyway 124 in the rotor such that rotation of the rotor causes a corresponding rotation of the carrier part 14 and the abrading or polishing head 18. Beneath the level of the lower bearing 40, the carrier part 14 has an enlarged portion 89' which is typically externally cylindrical about the axis 15. The enlarged portion 89' then contains a recess 90 centered about the second axis 17 which is parallel to but offset laterally from the axis 15. The orbitally driven part 16 has an upper reduced diameter portion 91 projecting upwardly into the recess 90 and is centered about the axis 17 and journaled by two bearings 92 and 93 for rotation about the axis 17 relative to the carrier 14, so that as the carrier turns the part 16 is given an orbital motion. The rotation of the lower enlarged portion 89' of carrier 14 causes orbital movement of the head 18 and its carried sandpaper sheet 19, to abrade the work surface 12.

A lower enlarged diameter flange portion 94 of the part 16 has an annular horizontal undersurface 95 disposed transversely of the axis 17. A threaded bore 96 extends upwardly into the part 16 and is centered about the vertical axis 17, for engagement with an externally threaded screw 97 which detachably secures the head 18 to the rest of the device. A counterweight plate 98 may be located vertically between the carrier 14 and the flange 94 of the part 16, and be secured rigidly to the part 14 by appropriate fasteners. It may be externally non-circular about the axis 15 to counterbalance the eccentrically mounted part 16, the head 18, and any other connected elements.

The carrier part 14 carries the part 16 and the abrading head 18. The head 18 may be rectangular in horizontal section, including an upper horizontally rectangular rigid flat metal backing plate 99 having a rectangular resiliently deformable cushion 100 at its underside, typically formed of foam rubber or the like. The sheet of sandpaper 19 extends along the undersurface of the cushion 100, and then extends upwardly at opposite ends of the head for retention of its ends by two clips 101. The screw 97 extends upwardly through an opening in the plate 99 to secure the head 19 to the orbitally moving part 16. In other embodiments, the head 18 and sandpaper 19 may have other cross-sections, such as a circular cross-section.

As shown in FIGS. 2 and 4, the body structure 11 of the tool 10 may be formed as an assembly of parts including a rigid main body part 22 having an internal surface 23 defining a recess within which the motor 13 is received. The part 22 may be metallic and may have an outer surface 24 of square horizontal section and an annular horizontal flange 25 at its upper end for confining the motor against upward removal from the body. A square cushioning element 26 may be carried about the body part 22 and extend across its upper side, and may be formed of an appropriate rubber, to function as a cushioned handle element by which the device is held in use. A rigid reinforcing element 27 is bonded to the undersurface of the top horizontal portion of the handle cushion 26, and with the attached part 26 is secured to the body 22 by four screws 28 (see FIG. 4) extending downwardly through vertically aligned openings or passages in the parts 22 and 27, with the heads of the screws engaging downwardly against the part 27, and with the lower ends of the screws being connected threadedly to a retainer 29 which is tightenable upwardly against the motor to retain it in the recess 30 formed within the body structure. The radially inner portion of the retainer 29 forms an upwardly facing annular horizontal shoulder surface 31 (see FIG. 4) which projects radially inwardly beyond the surface 23 to block downward withdrawal of the motor. The lower portion of the retainer 29 forms a tubular circular skirt 32 to which the upper end of a tubular rubber boot 33 is secured by an annular clamp 34.

The lower end 102 of the flexible tubular boot 33 carries and is permanently attached to a plate 103 preferably formed of sheet metal which is essentially rigid. Plate 103 has a horizontal circular portion 104 extending parallel to the upper surface of plate 99, and at its periphery has an upwardly turned cylindrical side wall portion 105 fitting closely about and bonded annularly to the lower externally cylindrical portion 102 of rubber boot 33. The plate 103 has a central opening 106 through which the screw 96 extends upwardly, so that upon tightening of the screw the plate 103 is rigidly clamped between the plate 99 and the element 16, with the boot 33 then functioning to retain the head 18 against rotation relative to the upper portion of the tool.

Although the drawings illustrate the invention as applied to a pneumatic orbital sander, it will be apparent that the novel aspects of the air motor arrangement of the invention may also be utilized in other types of portable pneumatic abrading or polishing tools. The preceding description has been presented with reference to various embodiments of the invention. Persons skilled in the art and technology to which this invention pertains will appreciate that alterations and changes in the described structures and methods of operation can be practiced without meaningfully departing from the principles, spirit and scope of this invention.

What is claimed is:

1. A rotor for a pneumatic motor, comprising:

an inner core;

an outer body surrounding the inner core, the outer body having a plurality of slots formed in an outer surface of the outer body, the slots extending from the outer surface of the outer body toward the inner core; and a plurality of clips inserted into the plurality of slots, each clip being positioned to abut an inner surface of one of the plurality of slots.

2. The rotor of claim 1, wherein each one of the plurality of slots further comprises a shelf formed in the inner surface of the slot near a bottom portion of the slot to receive the clip.

3. The rotor of claim 1, wherein each one of the plurality of slots further comprises a lip formed along a front edge of the slot.

4. The rotor of claim 1, further comprising a plurality of vanes dimensioned to slide into the plurality of slots.

5. The rotor of claim 1, wherein the plurality of clips is formed of steel.

6. The rotor of claim 1, wherein the plurality of clips has rounded corners.

7. The rotor of claim 1, wherein the plurality of clips is formed of a material having a hardness within the range of approximately 45 to approximately 50 on the Rockwell C scale.

8. A motor for an abrasive finishing tool comprising:

a rotor comprising a plurality of slots;

a housing containing the rotor;

a plurality of vanes dimensioned to slide within the slots to contact an inside surface of the housing; and a plurality of clips positioned in the plurality of slots between the plurality of vanes and an inside surface of the slots.

9. An abrasive finishing tool having a rotary pneumatic motor comprising:

a motor comprising a rotor configured to rotate inside a motor housing, the rotor comprising a vane slot;

a carrier part engaged with the rotor;

an abrasive surface attached to the carrier part; and a clip inserted into the vane slot.

10. The abrasive finishing tool of claim 9, wherein the vane slot further comprises a shelf formed in an inner surface of the vane slot near a bottom portion of the vane slot to receive the clip.

11. The abrasive finishing tool of claim 10, wherein the vane slot further comprises a lip formed along a front edge of the vane slot.

12. The abrasive finishing tool of claim 11, further comprising a vane dimensioned to slide into the vane slot.

13. The abrasive finishing tool of claim 12, wherein the clip is formed of steel.

14. The abrasive finishing tool of claim 12, wherein the clip has rounded corners.

15. The abrasive finishing tool of claim 12, wherein the clip is formed of a material having a hardness within the range of approximately 45 to approximately 50 on the Rockwell C scale.

16. The motor of claim 8, wherein each one of the plurality of slots further comprises a shelf formed in the inside surface of the slot near a bottom portion of the slot to receive the clip.

17. The motor of claim 8, wherein each one of the plurality of slots further comprises a lip formed along a front edge of the slot.

18. The motor of claim 8, wherein the plurality of clips is formed of steel.

19. The motor of claim 8, wherein the plurality of clips has rounded corners.

20. The motor of claim 8, wherein the plurality of clips is formed of a material having a hardness within the range of approximately 45 to approximately 50 on the Rockwell C scale.

* * * * *